US006546111B2

(12) United States Patent
Stede et al.

(10) Patent No.: US 6,546,111 B2
(45) Date of Patent: Apr. 8, 2003

(54) HEARING AID ANGLE PIECE FOR BEHIND-THE-EAR HEARING AIDS

(75) Inventors: Kai Stede, Bielefeld (DE); Stefan Sudmeier, Herford (DE)

(73) Assignee: AS Audio Service GmbH (DE)

( * ) Notice: Subject to any disclaimer, the term of this patent is extended or adjusted under 35 U.S.C. 154(b) by 0 days.

(21) Appl. No.: 10/048,391

(22) PCT Filed: Mar. 20, 2001

(86) PCT No.: PCT/EP01/03177

§ 371 (c)(1),
(2), (4) Date: Jan. 29, 2002

(87) PCT Pub. No.: WO01/93632

PCT Pub. Date: Dec. 6, 2001

(65) Prior Publication Data

US 2002/0106095 A1 Aug. 8, 2002

(30) Foreign Application Priority Data

May 30, 2000 (DE) ..... 200 09 593 U

(51) Int. Cl.[7] ..... H04R 25/00
(52) U.S. Cl. ..... 381/330; 381/322
(58) Field of Search ..... 381/322, 324, 381/327, 328, 330, 313, 356, 381, FOR 132, FOR 133, FOR 134, 382; 181/129, 130, 135

(56) References Cited

U.S. PATENT DOCUMENTS

| | | | | |
|---|---|---|---|---|
| 3,193,048 A | | 7/1965 | Kohler et al. | 181/31 |
| 3,798,390 A | | 3/1974 | Gage et al. | 179/107 |
| 3,835,263 A | * | 9/1974 | Killion | 381/313 |

FOREIGN PATENT DOCUMENTS

| | | |
|---|---|---|
| DE | 2624240 | 5/1976 |

* cited by examiner

*Primary Examiner*—Huyen Le
(74) *Attorney, Agent, or Firm*—Bourque & Associates, PA

(57) ABSTRACT

A hearing aid fitting for a behind-the-ear hearing aid possesses two sound inlet apertures on different sides of the fitting. One sound inlet aperture faces toward the head and the other faces in the opposite direction. Both sound inlet apertures are connected to a channel leading to the behind-the-ear hearing aid. An insertable sealing stopper that is shaped to fit the aperture is provided for each sound inlet aperture. One of these sealing stoppers seals the sound inlet aperture facing the head. The two sealing stoppers may be of different color or exterior side texture for differentiation one from the other.

5 Claims, 1 Drawing Sheet

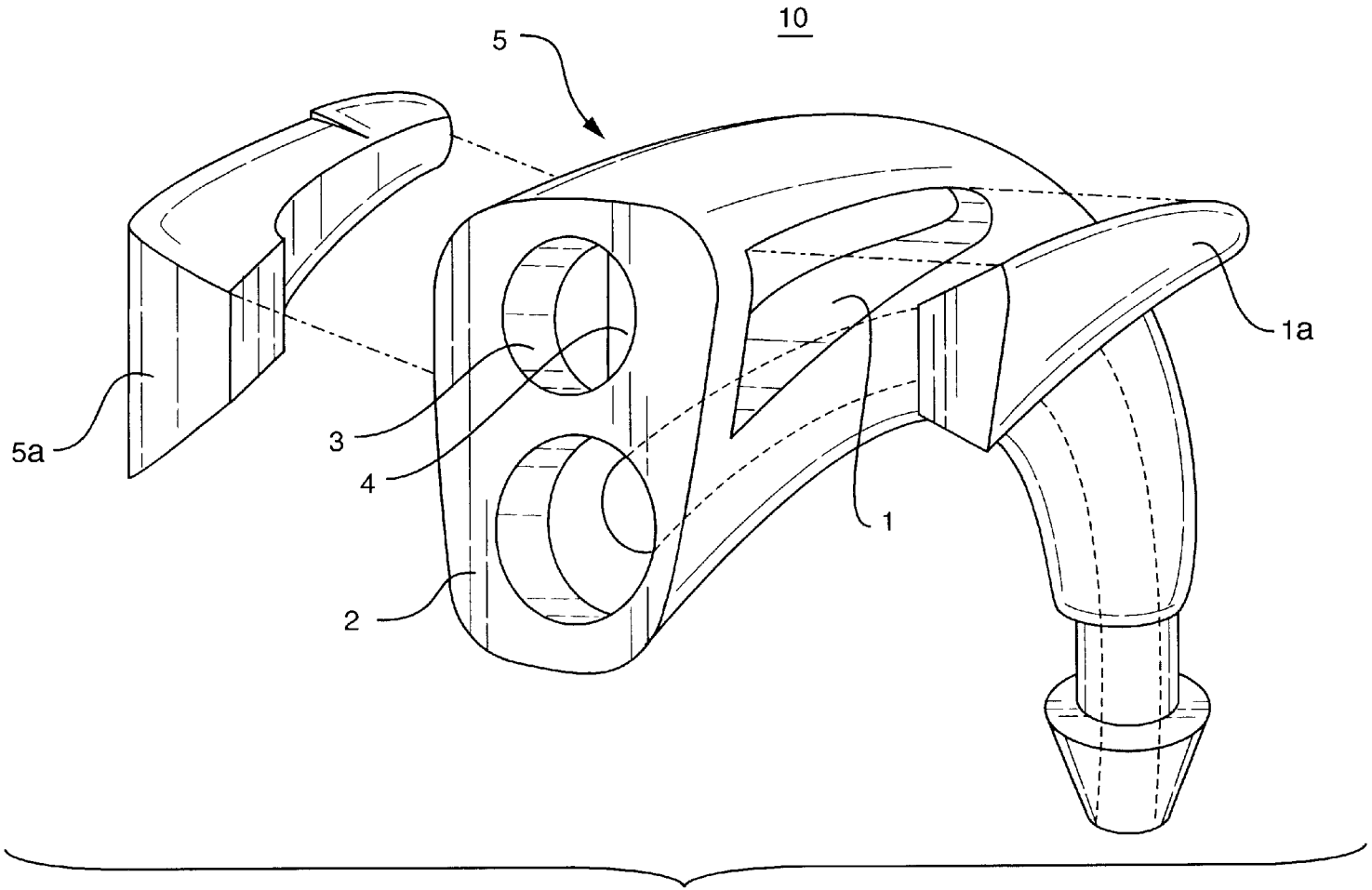
10
5
5a
1a
1
3
4
2

HEARING AID ANGLE PIECE FOR BEHIND-THE-EAR HEARING AIDS

FIELD OF THE INVENTION

The invention relates to a hearing aid fitting for behind-the-ear hearing aids.

BACKGROUND OF THE INVENTION

Typical hearing-aid fittings, also known as supporting hooks, are connected with the housing of a behind-the-ear hearing aid, by, for example, a connector that is threaded or clipped. For known hearing-aid fittings, the sound inlet apertures are located on opposing sides of the fittings. The sound inlet apertures provided on both sides allow use of a known fitting independent of whether it serves to connect to a hearing aid worn behind the right ear or one worn behind the left ear.

In the condition as worn, one of the two sound inlet apertures is against the head or hair. Such a solution is unsuitable, because dirt and perspiration, among other things, may enter the aperture facing the wearer's head. Also, interfering rustling sounds caused by the hair may enter through these sound inlet apertures facing the wearer's head.

SUMMARY OF THE INVENTION

Based on this state of the art, it is the task of the invention to create a hearing aid fitting of the known type so that is suitable as a supporting hook for both ears, and is greatly resistant to contamination of foreign objects as well as unwanted sounds.

With the hearing-aid fitting provided by the invention, the sound inlet aperture facing the head may be plugged by the use of a custom-sealing stopper, while the opposing sound inlet aperture facing outwards remains unplugged. Provision of a sealing stopper also allows the opening of a sound inlet aperture plugged by a sealing stopper when needed. By sealing the aperture, contamination can no longer enter from the head side and the rustling sounds created by the hair are reduced.

BRIEF DESCRIPTION OF THE DRAWINGS

These and other features and advantages of the present invention will be better understood by reading the following detailed description, taken together with the drawings wherein:

FIG. 1 shows a schematic, perspective exploded view of the hearing aid fitting with two sealing stoppers in accordance with the present invention.

DETAILED DESCRIPTION OF THE PREFERRED EMBODIMENTS

The design of the hearing aid's basic body is unchanged with respect to known solutions. The hearing-aid fitting 10 constructed in accordance with the present invention includes a flange 2 that may be threaded or clipped together with the behind-the-ear hearing aid (not shown) as is well known in the art. Sound inlet apertures 1 and 5 are provided on both sides. The sound inlet aperture 1 is visible in the drawing; the sound inlet aperture 5 is not visible because it is positioned on the opposite side of the hearing aid fitting from the sound inlet aperture 1 at the same height. It is a mirror image of the sound inlet aperture 1.

The two sound inlet apertures 1 and 5 are separated from each other by an interior partition 4 in the embodiment form shown. Both sound inlet apertures 1 and 5 feed into a common sound inlet channel 3 that is connected with a corresponding sound inlet area of the behind-the-ear hearing aid (not shown).

Mirror-symmetrical sealing stoppers 1*a* and 5*a* are provided to seal the sound inlet apertures 1 or 5. The sealing stoppers 1*a* and 5*a* are so formed that they may be smoothly inserted flush into the sound inlet aperture, and may be connected with the basic body of the hearing aid via a force- or shape-fit. The various sealing stoppers may also be easily removed from their seated position. Only the sound inlet aperture facing the head of the behind-the-ear hearing-aid wearer is sealed while the other remains open.

A further advantage of the hearing-aid fitting based on the present invention results from various characteristics of the different plugs. A varying characteristic can, for example, be a different color. Thus, one may designate the hearing aid to be worn on the right ear with a red stopper, and the hearing aid to be worn on the left ear with a blue stopper. Such designation has considerable practical significance, since the settings of hearing aids for different sides are, as a rule, different. By means of this designation, unintentional swapping of the devices is impossible, for example such as can easily occur when the fitting inserted into the ear is removed for cleaning. It is also possible to provide differing designation by the use of varying surface textures so that identification by blind or color-blind users is ensured.

Accordingly, the present invention provides a hearing aid fitting that is reversible, that can be coded for the user as the one for the right or left ear, and that reduces contamination of the sound inlet by foreign objects or unwanted sounds.

Modifications and substitutions by one of ordinary skill in the art are considered to be within the scope of the present invention, which is not to be limited except by the following claims.

The invention claimed is:

1. A hearing-aid fitting for a behind-the-ear hearing aid comprising:

a hearing aid fitting having two sound inlet apertures disposed on opposite sides of said fitting, wherein one aperture faces the head of a user and the other aperture faces outwardly, both of said sound inlet apertures connected via a sound inlet channel leading to a hearing aid sound inlet channel when in use; and at least one insertable sealing stopper that is shaped to fit one of said two sound inlet apertures, said at least one sealing stopper disposed in the sound inlet aperture facing the head when in use.

2. The hearing aid fitting as in claim 1 wherein said at least one insertable sealing stopper comprises two insertable sealing stoppers, and wherein said two sound inlet aperatures and said two insertable sealing stoppers are essentially mirror images of one another.

3. The hearing aid fitting as in claim 1 wherein said at least one insertable sealing stopper comprises two insertable sealing stoppers of different colors.

4. The hearing aid fitting as in claim 1 wherein said at least one insertable sealing stopper comprises two insertable sealing stoppers each having an exterior surface possessing different exterior surface textures.

5. The hearing-aid fitting as in claim 1 wherein said at least one insertable sealing stopper comprises two insertable sealing stoppers connected with the hearing-aid fitting apertures using one method selected from the group consisting of force fit and shape fit.

* * * * *